US010119271B2

(12) United States Patent
Franck

(10) Patent No.: US 10,119,271 B2
(45) Date of Patent: Nov. 6, 2018

(54) BUILDING OR CONSTRUCTION AND METHOD FOR PRODUCTION THEREOF

(71) Applicant: Jan Franck, Weidenberg (DE)

(72) Inventor: Jan Franck, Weidenberg (DE)

( * ) Notice: Subject to any disclaimer, the term of this patent is extended or adjusted under 35 U.S.C. 154(b) by 0 days.

(21) Appl. No.: 15/307,245

(22) PCT Filed: Apr. 28, 2015

(86) PCT No.: PCT/IB2015/000590

§ 371 (c)(1),
(2) Date: Oct. 27, 2016

(87) PCT Pub. No.: WO2015/166330

PCT Pub. Date: Nov. 5, 2015

(65) Prior Publication Data

US 2017/0044764 A1 Feb. 16, 2017

(30) Foreign Application Priority Data

Apr. 28, 2014 (DE) ..... 10 2014 005 990

(51) Int. Cl.
*E04B 2/56* (2006.01)
*E04C 2/52* (2006.01)
(Continued)

(52) U.S. Cl.
CPC ..... *E04B 2/56* (2013.01); *E04B 2/26* (2013.01); *E04B 2/66* (2013.01); *E04B 2/68* (2013.01);
(Continued)

(58) Field of Classification Search
CPC ..... E04B 2/56; E04B 2/84; E04B 2/66; E04B 2/26; E04B 2/68; E04B 1/165; E04C 2/521
See application file for complete search history.

(56) References Cited

U.S. PATENT DOCUMENTS 2,358,147 A * 9/1944 Colburn ..... E04B 2/84 425/DIG. 121
2,578,085 A * 12/1951 Perkins ..... E04B 2/56 52/313
(Continued)

FOREIGN PATENT DOCUMENTS

BE 737358 1/1970
GB 1007521 10/1965

*Primary Examiner* — Rodney Mintz
(74) *Attorney, Agent, or Firm* — Pandiscio & Pandiscio

(57) ABSTRACT

The invention relates to a method for producing a building as a timber-frame construction, frame construction, or post-and-beam construction, having a supporting framework consisting of pillars and/or struts, comprising the following steps: a) in the regions of subsequent pillars and/or struts of the timber-frame construction, frame construction, or post-and-beam construction plate-shaped wall building elements are provided with screws in such a way that the tips thereof protrude into the subsequent pillars and/or struts; b) behind the plate-shaped wall building elements shutterings for the supporting framework consisting of pillars and/or struts are produced from strips and/or insulating material; c) the shuttered regions for the framework are filled with a load-bearing, curable compound, in particular with concrete, wherein the hardening compound flows around the screws used in step a); d) after step a), at the latest after the curing of the compound, the plate-shaped wall elements are set up, fixed, and aligned; e) installation elements for electrical power, water, heating, etc. are mounted on the outer face of the plate-shaped wall building elements; f) plate-shaped wall building elements are fixed to the outer faces of the pillars and/or struts of the supporting timber-frame construction, frame construction, or post-and-beam structure; g) the remaining spaces between the plate-shaped wall building elements, the elements of the supporting framework, and/or
(Continued)

the installation elements for electrical power, water, heating, etc. are filled with a bulk material or an insulating material.

13 Claims, 2 Drawing Sheets

(51) Int. Cl.

| | |
|---|---|
| ***E04B 2/26*** | (2006.01) |
| ***E04B 2/84*** | (2006.01) |
| ***E04B 2/66*** | (2006.01) |
| ***E04B 2/68*** | (2006.01) |
| ***E04B 1/16*** | (2006.01) |

(52) U.S. Cl.
CPC ..... *E04B 2/84* (2013.01); *E04C 2/521* (2013.01); *E04B 1/165* (2013.01)

(56) References Cited

U.S. PATENT DOCUMENTS

| | | | | |
|---|---|---|---|---|
| 3,603,052 | A * | 9/1971 | Novoa | E04B 1/163 52/257 |
| 8,844,223 | B2 * | 9/2014 | Zhong | E04B 1/161 52/259 |
| 9,856,639 | B2 * | 1/2018 | Koszo | E04B 1/165 |
| 2012/0047816 | A1 * | 3/2012 | Zhong | E04B 1/161 52/11 |
| 2015/0204085 | A1 * | 7/2015 | Koszo | E04B 1/165 52/742.14 |

* cited by examiner

BUILDING OR CONSTRUCTION AND METHOD FOR PRODUCTION THEREOF

REFERENCE TO PENDING PRIOR PATENT APPLICATIONS

This patent application claims benefit of International (PCT) Patent Application No. PCT/IB2015/000590, filed 28 Apr. 2014 by Jan Franck for BUILDING OR CONSTRUCTION AND METHOD FOR PRODUCTION THEREOF, which claims benefit of German Patent Application No. DE 10 2014 005 990.1, filed 28 Apr. 2014, which patent applications are hereby incorporated herein by reference.

FIELD OF THE INVENTION

The invention is directed to a building as a timber-frame construction, frame construction, or post-and-beam construction, having a supporting framework made of pillars and/or struts, and to a method for the production thereof.

BACKGROUND OF THE INVENTION

Timber-frame, frame, or post-and-beam constructions have been known for some time. While a classical timber-frame construction is sometimes very laborious, modern frame or post-and-beam constructions can certainly be built more rapidly. However, in all of these types of construction, the planarity of walls is not a matter of course, because it is particularly dependent on the linear extension of the poles used—vertical pillars and horizontal or inclined struts. Furthermore, it is to be noted that buildings having pillars or struts made of wood generally work more strongly than so-called solid houses; this disadvantage may be avoided by using other materials for the post-and-beam construction, for example, concrete.

SUMMARY OF THE INVENTION

The problem which initiates the invention results from the disadvantages of the prior art, refining a wall construction of the type in question for a building such that the walls built thereby are as exactly planar as possible.

This problem is solved by a method for producing a building as a timber-frame construction, frame construction, or post-and-beam construction, having a supporting framework made of pillars and/or struts, having the following steps:

a) in the regions of later pillars and/or struts of the timber-frame, frame, or post-and-beam construction, plate-shaped wall structural elements are provided with elongated anchoring parts, such that the free ends thereof protrude into the later pillars and/or struts;
b) shutterings for the supporting framework made of pillars and/or struts are manufactured by brackets and/or insulation material behind the plate-shaped wall structural elements;
c) the shuttered regions for the framework are filled using a loadbearing, curing compound, in particular using concrete, wherein the curing compound flows around the screws used in step a);
d) after step a), at latest after the curing of the compound, the plate-shaped wall elements are set up, fixed, and aligned;
e) installation elements for power, water, heating, etc. are mounted on the outer side of the plate-shaped wall structural elements;

f) plate-shaped wall structural elements are fixed on the outer sides of the pillars and/or struts of the supporting timber-frame, frame, or post-and-beam framework;
g) the remaining intermediate spaces between the plate-shaped wall structural elements, the elements of the supporting framework, and/or the installation elements for power, water, heating, etc. are filled using an insulating material.

This procedure, constructing a wall from one wall panel gradually up to the opposite one—in particular in the case of exterior walls more or less from the inside to the outside—fundamentally differs from the previously performed procedure, of firstly building a shell in the form of a framework in the interior of the wall and then paneling this framework, which is accompanied by various advantages:

On the one hand, a wall element can be produced lying down if needed, optionally on a completely planar underlying surface. The later wall is then ideally planar. Furthermore, a maximum strength of the framework can be achieved by the use of concrete or another curing material. If needed, rebar or another reinforcement can be incorporated into the concrete.

Furthermore, such a construction method is very simple, because labor-intensive or difficult activities such as drilling or pegging are completely superfluous. For the external planking, fixing elements such as screws or the like can optionally also be incorporated into the regions of the framework before the pouring of the concrete. In addition, all installations can be integrated directly into the wall without any effort, in particular all pipes or lines.

The invention may be refined such that a wall is firstly put together and preassembled while lying on a table.

The invention recommends that during the horizontal preassembly, the plate-shaped wall structure elements lie lowermost.

The elongated anchoring parts can have a design such that, after the solidification of the curable compound, they are fixed in a formfitting manner therein, in particular in relation to vertical tensile stresses.

It is within the scope of the invention that the elongated anchoring parts, after the solidification of the curable compound, are removably fixed therein, in particular in the form of screws, which can be unscrewed from the solidified compound by rotational movements.

If the elongated anchoring parts have a coating which prevents sticking to the cured compound, for example, a thinly applied oil, thus, for example, screw-shaped anchoring parts are permanently captured in the longitudinal direction thereof by the third binder matrix, while a screwing movement is still possible and in this manner, for example, a removal of a plate-shaped wall element is possible if needed.

A further construction guideline states that the formwork for the supporting framework made of pillars and/or struts is formed as profiles having a U-shaped cross-section.

During the execution of the invention, it is recommended that the cross-sectionally U-shaped shutterings for the supporting framework be placed on the plate-shaped wall structural elements such that the opening of the "U" faces toward the plate-shaped wall structural elements.

The invention experiences a preferred refinement in that the cross-sectionally U-shaped shutterings, which are U-shaped in cross section, for the supporting framework are placed on the plate-shaped wall structural elements such that it overlaps one or more elongated anchoring parts.

To accommodate the edges of façade plates, the cross-sectionally U-shaped shutterings for the supporting framework can have a channel on each of their longitudinal edges connecting the middle web of the "U" to each lateral leg.

The invention furthermore offers the possibility that the cross-sectionally U-shaped shutterings for the supporting framework are penetrated by further anchoring parts, which extend from the raised region of the middle web between its two channels to accommodate façade plates up into the cavity inside the "U".

A building according to the invention as a timber-frame, frame, or post-and-beam construction, having a supporting framework made of pillars and/or struts, is distinguished in that the pillars or struts consist of a matrix made of a cured binder, for example, concrete, wherein plate-shaped wall structural elements are fastened on the pillars and/or struts by means of elongated anchoring parts, for example, screws, such that the free ends thereof are enclosed directly by the matrix of the pillars or struts, without pegging.

Surrounding the pillars and/or struts with insulating material has proven itself.

Further advantages result in that installation elements for power, water, and/or heating are mounted on regions inside the wall on the plate-shaped wall structural elements.

Finally, it corresponds to the teaching of the invention that regions inside the wall between the plate-shaped wall structural elements, the elements of the supporting framework, and/or the installation elements for power, water, and/or heating are filled using an insulating material.

BRIEF DESCRIPTION OF THE DRAWINGS

Further features, details, advantages, and effects on the basis of the invention result from the following description of a preferred embodiment of the invention and on the basis of the drawing. In the figures.

DETAILED DESCRIPTION OF THE PREFERRED EMBODIMENTS

Figure 1:
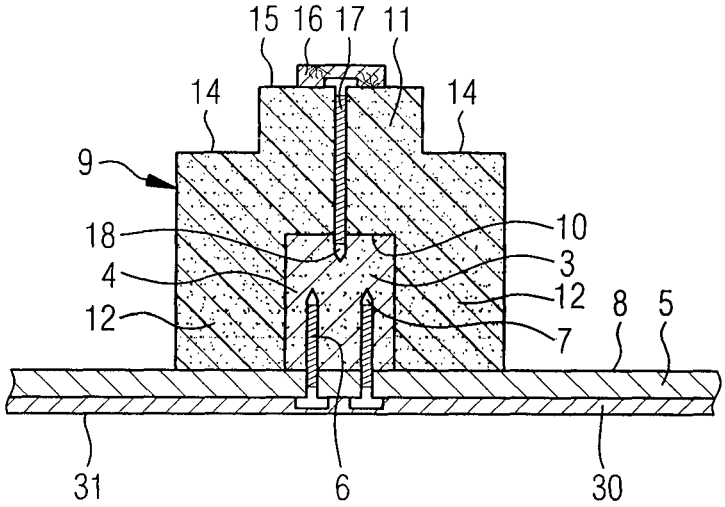
FIG. 1 shows a horizontal section through a wall element before attachment of the external paneling and the filling.
Figure 2:
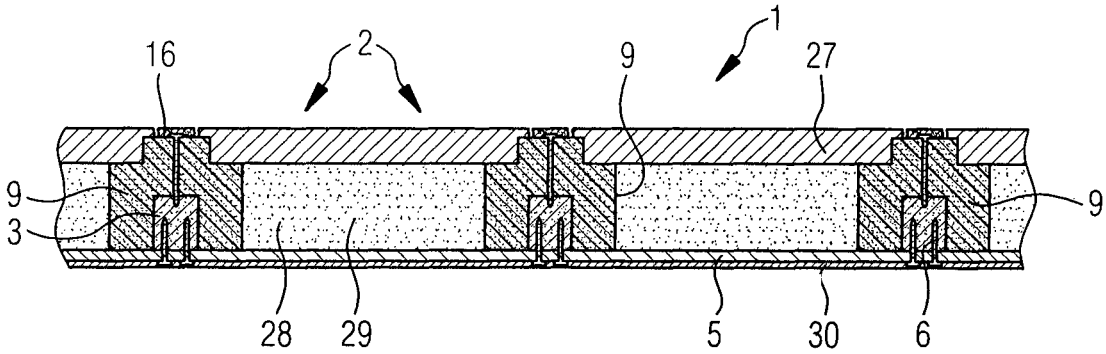
FIG. 2 shows a horizontal section through a wall element corresponding to FIG. 1, but in the finished installed state, i.e., after attachment of the external paneling and introduction of the filling.

The arrangement from FIG. 1 represents a special component according to the invention, whereby a (partial) building or (partial) construction (1) may be produced in a particularly efficient manner.

The invention proceeds in this case from the concept of post-and-beam construction, wherein a framework 2 is provided in the walls of the building or construction 1 as its static support. Pillars 3, which are loadable with pressure, having vertical longitudinal axes are used in this case to dissipate vertical, static loads, these pillars dissipating the weight of upper, loading stories of the building or construction 1 downward, in particular into lower stories and/or into a foundation. Because the pillars 3 have to remain as exactly vertically aligned as possible to fulfill their task, they are connected to one another by struts which extend horizontally or inclined. In the scope of such a construction, in smaller buildings, pillars and struts made of wood are often used (so-called timbered houses). However, the post-and-beam construction is also especially to be encountered in particularly tall buildings, where the framework often consists of steel or concrete reinforced with steel (so-called high-rise buildings).

One disadvantage of such a skeleton construction having a supporting framework made of steel and/or concrete is that such a framework is only paneled later on location, which is additionally linked to a substantial effort because of the hard and/or brittle consistency of steel and concrete.

In spite of these disadvantages, the invention uses a matrix having a curing binder 4, in particular concrete, for the framework 2, i.e., for the pillars 3 and struts.

The various pillars 3 and/or struts are firstly connected to one another during the assembly by a plate-shaped wall element 5, which extends in the wall plane, in the case of an external wall preferably along the inner wall surface.

In the scope of the construction according to the invention, pre-manufacturing can take place, for example, in a factory, but if needed also on location at a construction site. In this case, individual wall segments are pre-manufactured, which are then only joined together at the construction 1.

The preassembly of a wall segment is preferably performed lying down, in particular on a table of sufficient size. The lowermost layer of a wall segment to be preassembled is formed by a plate-shaped wall element 5 in this case, which later remains permanently in the wall segment. The plate-shaped wall element 5 is later to externally delimit a cavity for accommodating a bulk material or other filling, on the other hand, it is to connect the pillars 3 and/or struts of the framework 2 to one another and thus stiffen them, and finally it is to keep moisture away from the actual wall surface.

Therefore, plates made of wood, for example, plywood plates such as veneer plywood plates, blockboard or laminboard plates or laminated timber plates, also called cross-laminated timber plates; furthermore chipboard plates, in particular oriented strand board plates; and also fiberboard plates, for example, hard fiberboard plates or moderate-density fiberboard plates, have therefore proven themselves as the plate-shaped wall element in particular. All of these plates share the feature that the wood does not consist of a single, unprocessed raw wood layer, but rather receives completely omnidirectional properties as much as possible and therefore hardly still works, as a result of a combination of many small wood elements with various fiber directions and/or as a result of a binder which connects the individual components to one another.

The connection of such a plate-shaped wall element 5 to the individual pillars 3 or struts is performed by means of elongated anchoring parts, for example, in the form of screws 6, in particular wood screws, the heads of which are each enclosed by a plate-shaped wall element 5 on its lower side during the assembly or are accommodated in depressions therein. The free shaft ends 7 of these screws 6 point upward during the preassembly in this case, as is recognizable in FIG. 1.

Furthermore, in FIG. 1, it is apparent that shuttering elements 9 are laid on the flat side 8 of a plate-shaped wall element 5, which is on top during the assembly.

These shuttering elements 9 have the form of elongated profiles having a consistent cross section, preferably having a U-shaped cross section; such a U cross section can have a relatively simple geometry; it arises from a profile having a rectangular cross section, for example, in that a groove 10 having approximately rectangular cross section, for example, is worked out on one longitudinal side of such a rectangular profile, approximately in the middle.

Accordingly, the remaining profile body receives the typical U-shape having a middle web 11 and two lateral legs 12, which are parallel to one another and protrude approximately perpendicularly from the middle web 11 in the same direction.

It is clearly recognizable in particular in FIG. 1 that the free end faces 13 of the two lateral legs 12 of the U-profile shaped shuttering element 9 are planar and are aligned with one another, i.e., they span a shared plane. Therefore, it is possible to place the shuttering elements 9 with the free end face 13 thereof facing downward on the upwardly facing flat rear side 8 of a plate-shaped wall element 5. They can be fixed there at the desired positions, for example, by means of wood glue or another adhesive, however, preliminary fixation is also sufficient for the preassembly, for example, by means of adhesive strips.

During the preassembly, it is to be ensured that the free shaft ends of the elongated anchoring means, in particular screws 6, which penetrate the plate-shaped wall element 5 plunge from below into the cavity formed by the groove 10 of a shuttering element 9 and end freely therein. A channel 14 extending in the longitudinal direction of the formwork profile 9 is provided in each case in the region of outer edges, which face upward after such a preassembly, between the middle web 11 and each lateral leg 12 of a U-profile shaped shuttering element 9, wherein all of these channels 14 preferably have the same square or rectangular cross section, as may be seen in FIG. 1.

Furthermore, strip-shaped cover elements 16 are fixed on the outer side 15 of the middle webs 11 of the U-shaped shuttering elements 9 between the two channels 14 in each case, preferably by means of elongated anchoring elements, for example, screws 17, in particular wood screws. It is to be ensured in this case that the screws 17 are sufficiently long that the free shaft ends 18 thereof extend up into the cavity formed by the groove 10.

After the shuttering elements 9 have been prepared in this manner, the cavities formed by the grooves 10 thereof can be filled by an initially liquid to pasty substance having a curable binder, for example, by means of hoses inserted laterally into the cavities formed by the grooves 10. If the pillars 3 and/or struts of the framework 2 are to be reinforced, iron bars can be inserted beforehand into the formwork cavities provided by the grooves 10.

In this case, it is to be ensured that in any case the free shaft ends 7, 18, which end inside this cavity, of the screws 6, 17 or other elongated fixing means have previously been wetted using an antistick agent, for example, using an oil, so that the hardened binder matrix 4 does not adhere to the screws 6, 18 or other elongated fixing means, but rather only flows around them in a formfitting manner. This has the advantage that the screws 6, 17 can be removed if needed from the cured binder 4 of the pillars 3 or struts of the framework 2, in particular by unscrewing; however, these screws 6, 17 can just as well be screwed back in again, and in each case without pegging.

Furthermore, before the curing of the binder, still further mounting parts can be plugged into the cavities provided by the grooves 10, for example, bracket-type anchoring means for installing toilet seats, washbasins, or the like, but also connecting brackets for connecting such a wall segment to an adjacent wall segment.

After the curing of the binder matrix 4, the framework 2 is stiff per se; the pillars 3 are connected via the screws 6 to the plate-shaped wall elements 5 and possibly to further struts of the framework 2. If necessary, inner iron rods ensure, as a reinforcement, a further increased strength of the wall segments preassembled in this manner. The assemblies can therefore now be transported in this state to the construction site, if the preassembly has taken place on a factory site. The preassembled wall segment assemblies are set up and aligned on location and connected to adjacent wall segments, for example, by screwing together connecting brackets embedded in the concrete in the framework 2, which can then be mortared in using cement or the like, for example, to connect the various framework parts 2 of adjacent wall segments to one another in a formfitting and integrally-joined manner.

If this has been performed and if all wall segments for a construction section have been built in this manner, for example, in a next work step, the installation of electrical, water, gas, and heating units can be performed; these measures can also already be prepared at the factory, however.

Figure 3:
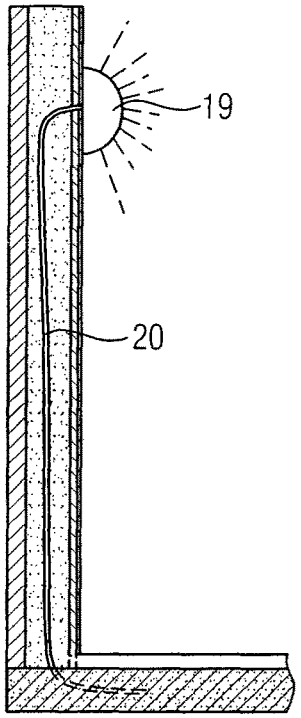
FIG. 3 shows a vertical section through a wall element having an integrated power installation.
Figure 4:
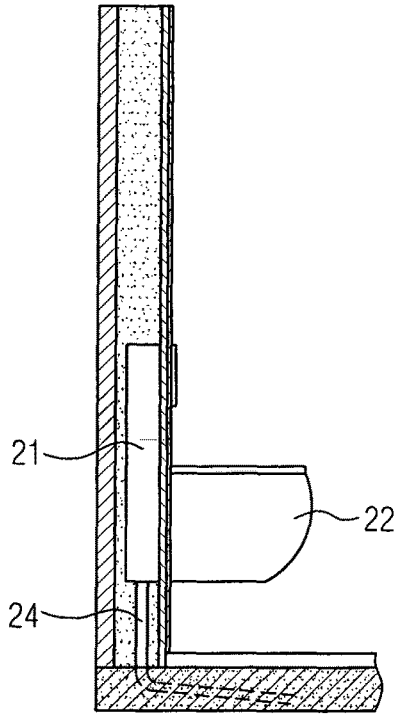
FIG. 4 shows a vertical section through a wall element having an integrated water installation for a toilet seat.
Figure 5:
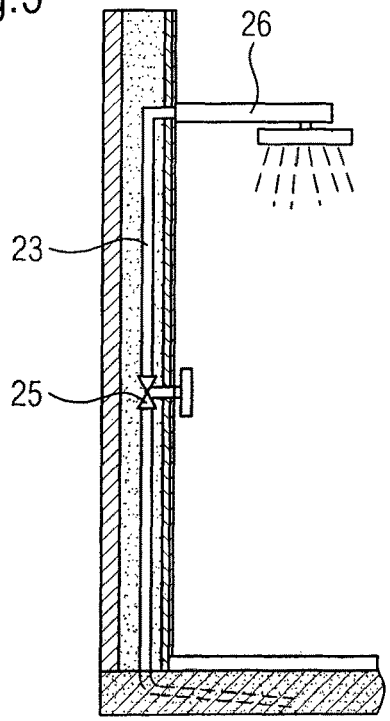
FIG. 5 shows a vertical section through a wall element having an integrated wall installation for a shower.

The installation of such units is indicated in FIGS. 3 to 5:

For example, for an electric installation according to FIG. 3, holes can be cut into the plate-shaped wall element 5 at the desired points and electrical sockets can be placed therein, for example, for wall lamps 19, power outlets, switches, etc. The laying of the cable 20 is performed on the flat side 8 of the plate-shaped wall elements 5 facing toward the framework 2, either directly or in cable conduits fastened thereon, so that the cables 20 could be replaced later. Cables 20 or cable conduits can be screwed by means of screws or clamps or the like directly onto the flat side 8 of the plate-shaped wall elements 5.

FIG. 4 shows that even water tanks 21 for flushing toilets can be mounted on the flat side 8 between two pillars 3. In this case, however, the anchoring—and also the mechanical anchoring for a toilet seat 22 itself—is better performed on the struts or pillars 3 of the framework 2 itself, for example, on anchoring brackets embedded in concrete therein—which protrude out of the relevant shuttering part 9. The water supply lines 23 and/or the wastewater lines 24 can also be anchored directly on the flat sides 8 of the plate-shaped wall elements 5 facing toward the framework 2.

It is apparent from FIG. 5 that fittings, for example, valves 25 interconnected in a water supply line 23, can also be fastened on the flat sides 8 of the plate-shaped wall elements 5, as well as other fittings, for example, water taps or connections for a shower 26 or the like.

After all installations are completed, the intermediate spaces between adjacent shuttering bodies 9 are closed in the region of the outer sides 15 thereof by means of plates 27. These plates 27 can each extend between two channels 14, which face toward one another, of adjacent pillars 3 or struts of the framework 2. They can be held at the positions thereof by brackets laid under the cover element, which encompass the inserted plates 27.

The plates 27 are preferably plates made of a mineral material such as stone, concrete, clinker brick, wood, or the like, which can immediately also be used as the external façade. If a further façade is to be hung in front, the plates 27 can also consist of other materials, for example, plastic or hard foam.

If the plates 27 are anchored on location, the cavity 28 remaining between the flat side 8 of the plate-shaped wall elements 5, the pillars 3 or struts of the framework 2, and the inserted plates 27 is filled with a bulk material 29, for example, with sand.

A plasterboard plate 31 or clay building plate or the like can also be screwed onto the flat side 30 of the plate-shaped wall elements 5 facing toward the room for the purpose of internal construction, or the plate-shaped wall elements 5 are immediately wallpapered, for example. Instead of a plasterboard plate 31, profiled boards made of wood can also be screwed directly onto the completely planar wall construction plate 5.

In summary, the advantages of the invention may be attributed to the fact that the shuttering element 9, together with the plate-shaped wall elements 5, encloses a cavity, into which screws 6, 17 extend from various sides. After the pouring of concrete or similar curing material 4 into the cavity and curing of this material 4, the screws 6, 17 have the relevant material 4 flow directly around them and are thus solidly held. If an antistick agent is used, it is additionally possible that the screws 6, 17 are solidly anchored in the binder matrix 4, but are nonetheless detachable therefrom.

Various installation elements 19-26 can be laid and/or mounted in the compartments between the various shuttering elements and/or the cured concrete pillars 3 or supports, for example, lines 20, power outlets and other electrical material, water supply and drainage pipes 23, 24, and possibly rinsing containers 21.

The individual wall segments are completely planar due to the horizontal preassembly.

In that the compartments are closed using further plate elements 27 on the outer or rear sides thereof after the final assembly on location, and the remaining cavities 28 are filled, good sound insulation and/or thermal insulation additionally results, while the concrete pillars 3 ensure sufficient stability of the wall segments, so that they can no longer deform and remain exactly planar.

LIST OF REFERENCE NUMERALS

| | |
|---|---|
| 1 | (partial) building or construction |
| 2 | framework |
| 3 | pillars |
| 4 | cured binder |
| 5 | plate-shaped wall element |
| 6 | screws |
| 7 | free shaft end |
| 8 | flat side |
| 9 | shuttering element |
| 10 | groove |
| 11 | middle web |
| 12 | lateral leg |
| 13 | free end face |
| 14 | channel |
| 15 | outer side |
| 16 | cover element |
| 17 | screws |
| 18 | free shaft end |
| 19 | wall lamp |
| 20 | cable |
| 21 | water tank |
| 22 | toilet seat |
| 23 | water supply line |
| 24 | wastewater line |
| 25 | valve |
| 26 | shower |
| 27 | plate |
| 28 | cavity |
| 29 | bulk material |
| 30 | flat side |
| 31 | plasterboard plate |

The invention claimed is:

1. A method for producing an exterior wall of a building having a supporting framework made of at least one pillar, characterized by the following steps:

a) providing plate-shaped wall elements comprising an inner surface and an outer surface, wherein a plurality of elongated anchoring screws extend from the outer surface of the plate-shaped wall elements into regions to be occupied by the at least one pillar such that free ends of the plurality of elongated anchoring screws protrude into the regions to be occupied by the at least one pillar;

b) providing at least one shuttering element to surround the regions to be occupied by the at least one pillar such that the at least one shuttering element provides a shuttering for the at least one pillar to be formed behind the plate-shaped wall elements;

c) forming the at least one pillar by filling regions defined by the at least one shuttering element with a loadbearing, curing compound, such that the curing compound flows around the plurality of elongated anchoring screws used in step a);

d) before or after step a), and at latest after curing of the compound poured in step c), the plate-shaped wall elements are set up, fixed, and aligned such that the inner surface of the plate-shaped wall elements face an interior of the building;

e) mounting installation elements on the outer surface of the plate-shaped wall elements, such that the installation elements face an exterior of the building;

f) mounting façade plates to the at least one pillar such that the façade plates face the exterior of the building, and such that an intermediate space exists between the plate-shaped wall elements and the façade plates; and g) filling the intermediate space between the plate-shaped wall elements, the at least one pillars, the installation elements and the façade plates with a bulk material;

h) wherein construction of the exterior wall commences at the plate-shaped wall elements facing the interior of the building;

i) wherein after solidification of the curable compound, the plurality of elongated anchoring screws are detachably fixed therein such that the plurality of elongated anchoring screws are configured to be unscrewed from the solidified curable compound by rotational movements.

2. The method according to claim 1 characterized in that after the solidification of the curable compound the plurality of elongated anchoring screws are fixed in a form-fitting manner therein in relation to vertical tensile stresses.

3. The method according to claim 1 wherein the exterior wall comprises at least two pillars, and further wherein the exterior wall comprises at least one strut extending between the at least two pillars.

4. The method according to claim 1 wherein the installation elements comprise at least one selected from the group consisting of power, water and heating.

5. The method according to claim 1 characterized in that the plurality of elongated anchoring screws comprise a coating, which prevents sticking to the cured compound.

6. The method according to claim 5 wherein the coating comprises a thinly applied oil.

7. The method according to claim 1, characterized in that the exterior wall is at least one of initially joined together or preassembled lying on a table.

8. The method according to claim 7, characterized in that the plate-shaped wall elements lie lowermost during a horizontal preassembly.

9. The method according to claim 1 characterized in that the at least one shuttering element is formed as profiles having a U-shaped cross-section.

10. The method according to claim 9, characterized in that the at least one cross-sectionally U-shaped shuttering element is mounted to the plate-shaped wall elements such that an opening of the U-shape is a groove therein, faces toward the inner surface of the plate-shaped wall elements.

11. The method according to claim 9 characterized in that the at least one cross-sectionally U-shaped shuttering element is mounted to the plate-shaped wall elements such that the at least one cross-sectionally U-shaped shuttering element overlaps one or more of the plurality of elongated anchoring screws.

12. The method according to claim 9 characterized in that each said at least one cross-sectionally U-shaped shuttering element has a channel on longitudinal edges thereof connecting a middle web of the U-shape to one lateral leg in each case, for accommodating edges of façade plates or other construction plates.

13. The method according to claim 9 characterized in that the at least one cross-sectionally U-shaped shuttering element is penetrated by further anchoring parts, which extend from a raised region of a middle web between two channels thereof for accommodating façade plates or other construction plates up into a cavity within the U-shape.

* * * * *